US010149994B1

(12) United States Patent
Pluim mentz

(10) Patent No.: US 10,149,994 B1
(45) Date of Patent: Dec. 11, 2018

(54) ADJUSTABLE DRAG RESISTANCE WATER EXERCISE EQUIPMENT

(71) Applicant: Irene S Pluim mentz, Santa Fe, NM (US)

(72) Inventor: Irene S Pluim mentz, Santa Fe, NM (US)

( * ) Notice: Subject to any disclaimer, the term of this patent is extended or adjusted under 35 U.S.C. 154(b) by 0 days.

(21) Appl. No.: 15/495,586

(22) Filed: Apr. 24, 2017

(51) Int. Cl.

| | |
|---|---|
| ***A63B 21/00*** | (2006.01) |
| ***A63B 21/008*** | (2006.01) |
| ***A63B 23/02*** | (2006.01) |
| ***A63B 23/04*** | (2006.01) |
| ***A63B 23/12*** | (2006.01) |

(52) U.S. Cl.
CPC ..... *A63B 21/0084* (2013.01); *A63B 21/4015* (2015.10); *A63B 21/4035* (2015.10); *A63B 23/02* (2013.01); *A63B 23/04* (2013.01); *A63B 23/12* (2013.01); *A63B 2225/09* (2013.01)

(58) Field of Classification Search
CPC ..... A63B 21/0023; A63B 21/0084; A63B 21/0088; A63B 21/0428; A63B 21/28; A63B 21/0004
See application file for complete search history.

(56) References Cited

U.S. PATENT DOCUMENTS

| | | | | |
|---|---|---|---|---|
| 1,660,234 | A * | 2/1928 | Pezuto | A63B 21/0004 482/125 |
| 3,204,955 | A * | 9/1965 | Quire | A63B 21/0004 482/91 |
| 4,969,644 | A * | 11/1990 | Hlaing | A63B 21/0004 482/126 |
| 2011/0183784 | A1* | 7/2011 | Celone | A63B 21/0088 473/422 |
| 2013/0303343 | A1* | 11/2013 | Tritton | A63B 21/0442 482/122 |

* cited by examiner

*Primary Examiner* — Jennifer M Deichl

(57) ABSTRACT

There is provided an article of adjustable drag resistance water exercise equipment comprised of a rectangular piece of material (11) with a handle (12A) attached to either end, and an identical handle (12B) looped around the material. By holding the handles (12A-12B) in either one hand or both hands of a user, or one handle (12A or 12B) placed around one foot while the user holds the other handle(-s), it can be moved through water in multiple directions through several movement planes, therefore increasing muscular strength and endurance of upper and lower extremities and core muscles of the user, as well as improving stability and balance. The device can be adjusted for user length and resistance levels using the third handle (12B). The equipment is useful in aquatic therapy or group exercise situations with different populations (elderly, injured, overweight, the elite athletes, recreational fitness partaker, and many more) to increase surface area and drag. It can be used by any population capable of exercising in a body of water, such as a pool, lake or ocean.

5 Claims, 9 Drawing Sheets

ADJUSTABLE DRAG RESISTANCE WATER EXERCISE EQUIPMENT

CROSS-REFERENCE TO RELATED APPLICATIONS

Figure 1A:
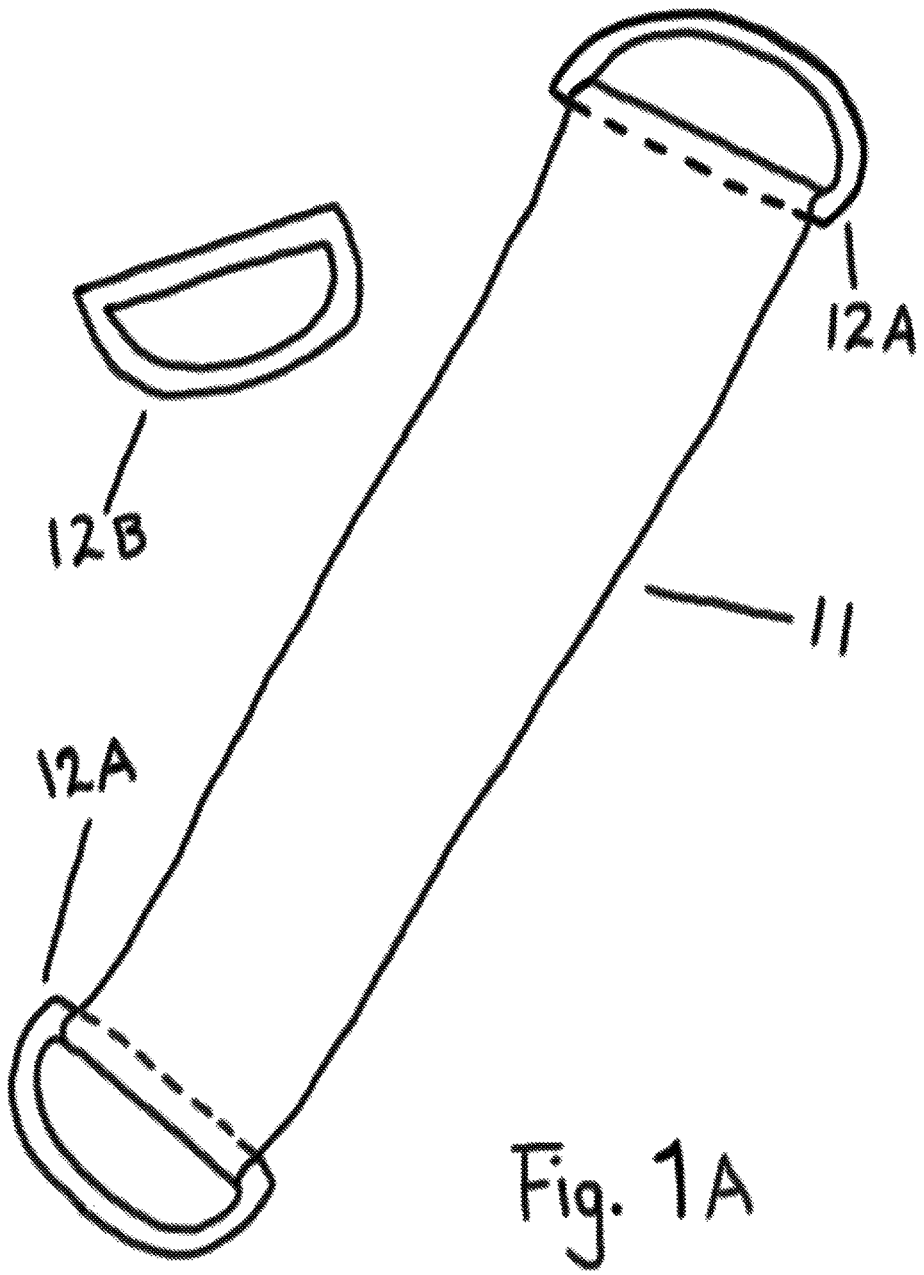

The present patent application claims the benefit of and priority over U.S. Provisional Patent Application Ser. No. 65/350,658, filed on Jun. 16, 2016, by this applicant, the entire disclosure of which is incorporated by reference herein.

FEDERALLY SPONSORED RESEARCH

Non applicable

SEQUENCE LISTING OR PROGRAM

Non applicable

BACKGROUND

This application relates to a piece of adjustable water exercise equipment to be used in a body of water where it creates drag resistance when the user moves it through different planes of movements. It easily can be adjusted to size and desired resistance level and can be used to increase strength and stamina of upper and lower extremities and core muscles by many different populations and in different settings, including but not limited to athletes, recreational fitness partakers, therapy situations, the elderly and infirm.

RELATED US APPLICATION DATA

Int. Cl. A63B21/00
US Cl. 272//116; 441/55/; 482//111
Field of search: 272/71, 272/116; 441/55, 441/56, 441/59, 441/124, 441/136; 482/51, 482/55, 482/92, 482/111, 482/122

REFERENCES SEARCHED

U.S. Pat. No. 3,913,907 Baker October 1975
U.S. Pat. No. 4,480,829 Yacoboski May 1983
U.S. Pat. No. 4,509,774 Booher August 1983
U.S. Pat. No. 4,521,011 Solloway September 1982
U.S. Pat. No. 4,565,369 Bedgood April 1983
U.S. Pat. No. 4,570,929 Shoemaker August 1983
U.S. Pat. No. 4,623,142 MacKechnie January 1984
U.S. Pat. No. 4,632,387 Guzman June 1984
U.S. Pat. No. 4,685,667 McDonald June 1986
U.S. Pat. No. 4,721,300 Guzman January 1988
U.S. Pat. No. 4,902,005 McNeill December 1988
U.S. Pat. No. 4,988,094 Beasky January 1991
U.S. Pat. No. 5,338,275 Chek June 1993
U.S. Pat. No. 6,058,925 Irvin et al. April 2000
U.S. Pat. No. 6,672,993 Stout January 2004
U.S. Pat. No. 6,962,553 Stout et al. June 2004
U.S. Pat. No. 7,090,618 Stout et al. December 2003
U.S. Pat. No. 7,314,433 Stout August 2005
U.S. Pat. No. 7,488,274 Sears March 2007
U.S. Pat. No. 7,582,045 Lombardi et al. November 2006
U.S. Pat. No. 7,621,851 Stout et al. April 2006
U.S. Pat. No. 7,727,123 Stout et al. May 2007
U.S. Pat. No. 7,794,364 Killgore et al. December 2004
U.S. Pat. No. 8,246,523 Stout et al. September 2009
U.S. Pat. No. 8,652,013 Stout et al. August 2012
U.S. Pat. No. 8,858,284 Sahun et al. October 2014

Patent Application Documents

2008/0161171 Wise October 2007
2008/0058179 Stout March 2008

2010/0292054 Karpus et al. May 2009
2013/0303343 Tritton May 2012

PRIOR ART

Although I searched many prior art, none are comparable to the adjustable drag resistance water exercise equipment described in this application. There are multiple pieces of equipment that utilize the principle of drag resistance. However, I realized most of this equipment is not adjustable to the size of the user nor for resistance level in a single piece of equipment. I found that many of these pieces of drag resistance equipment are large and can be used for just upper extremities or just lower extremities.

There is equipment available which looks similar to the embodiment in this patent application, (US 2013/0303343 and US 2010/0292054) but both use elastomeric material and therefore, when used in a body of water, will not function as the claimed device, nor does it have the same adjustability since it only has handles on either end and not the third handle, which gives the described device the adjustability that makes it unique.

SUMMARY

The adjustable drag resistance water exercise equipment is comprised of a rectangular piece of pliable material with rigid D-shaped handles affixed on either side and an additional identical handle looped around the material. By holding handles in either one hand or both hands of a user, it can be moved through water in multiple directions through several movement planes, therefore creating more resistance for arm, leg, and core muscles than moving the arms without the device. One handle can be placed around one foot while the user holds the other handle(-s), and again, by moving arm or leg or both through the water, muscles will exert greater energy than without.

The device can be adjusted for user length and resistance levels using the extra handle. It can be used by very active and rigorous athletes as well as by physical therapy recipients working on restoring joint function, and also by the recreational water exercise partaker to provide additional resistance. It can be used for overall body conditioning or isolated muscle strengthening. It can be used by many different demographics: athletes, people in rehab, the elderly, children, and more. It is easily folded into a small, portable package.

DRAWINGS

Figure 1B:
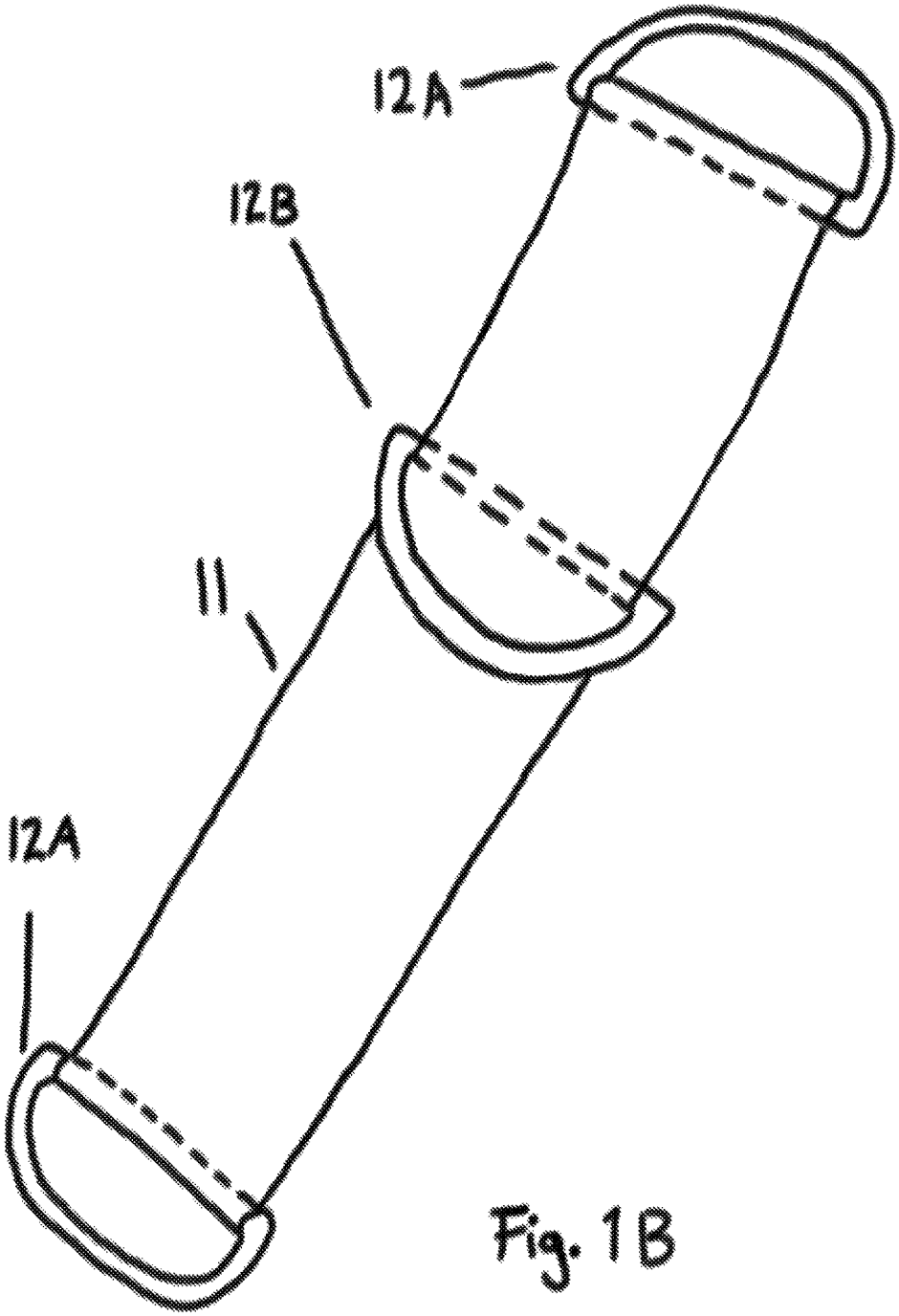
Figure 2:
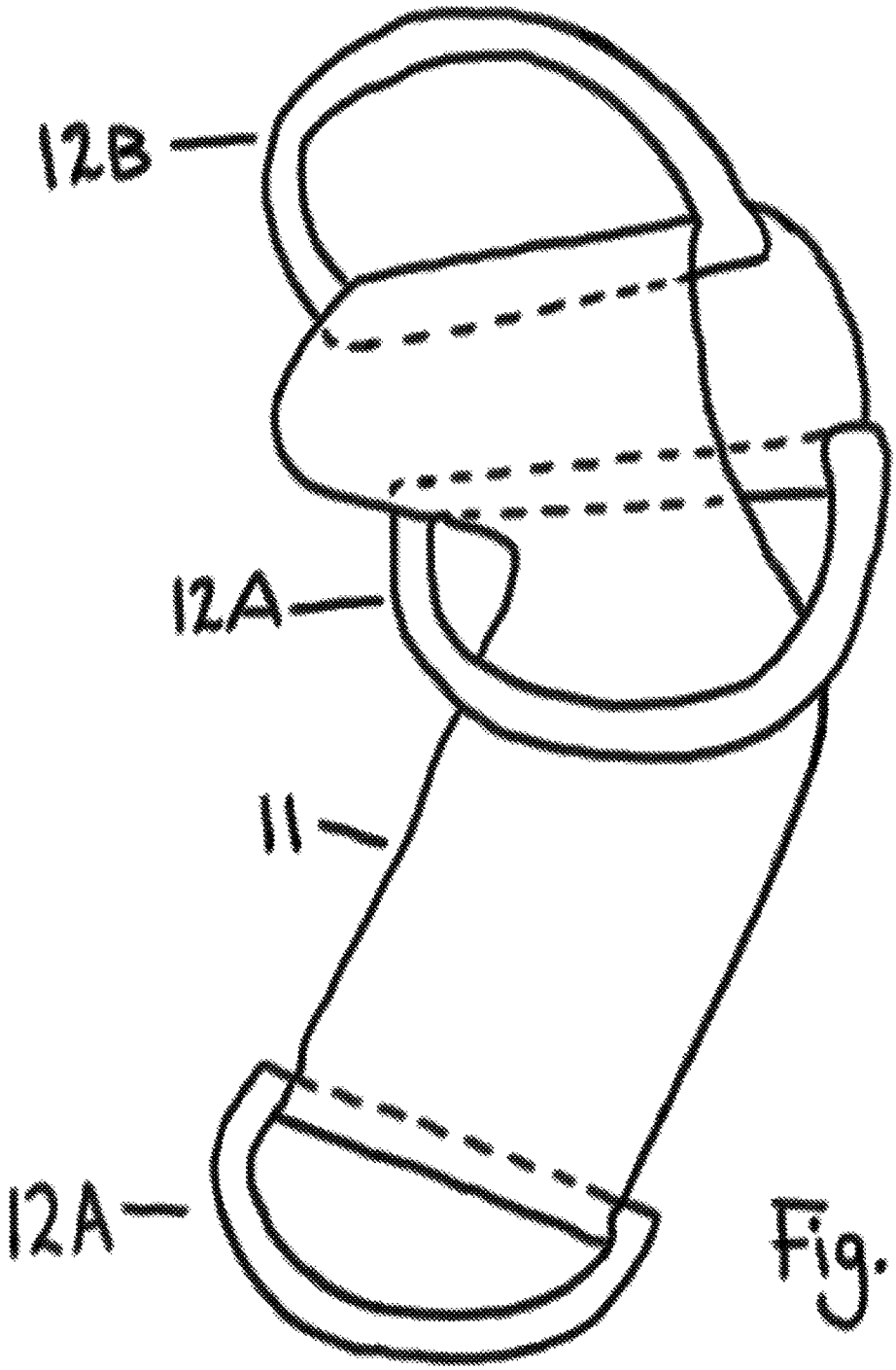
Figure 3:
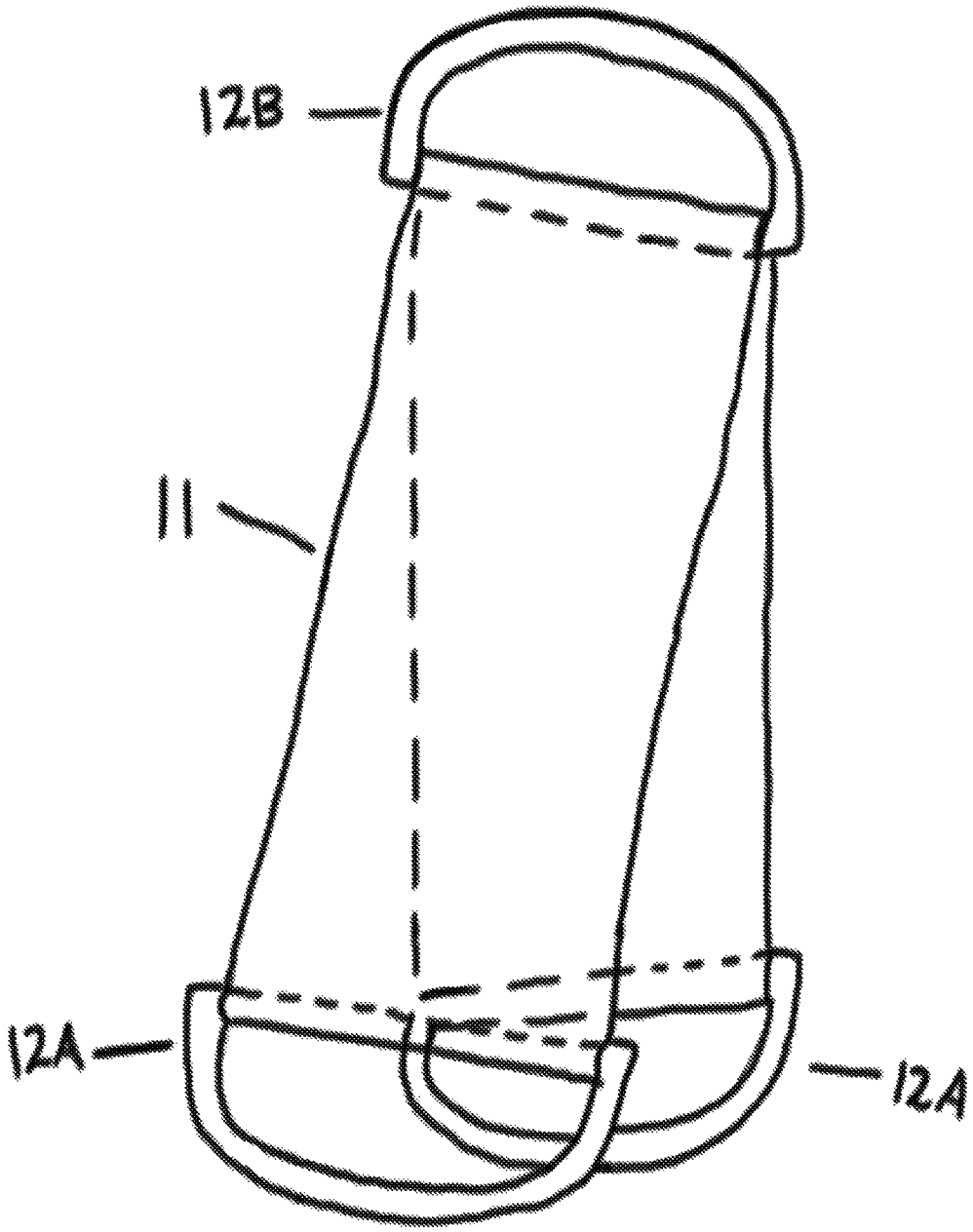
Figure 4:
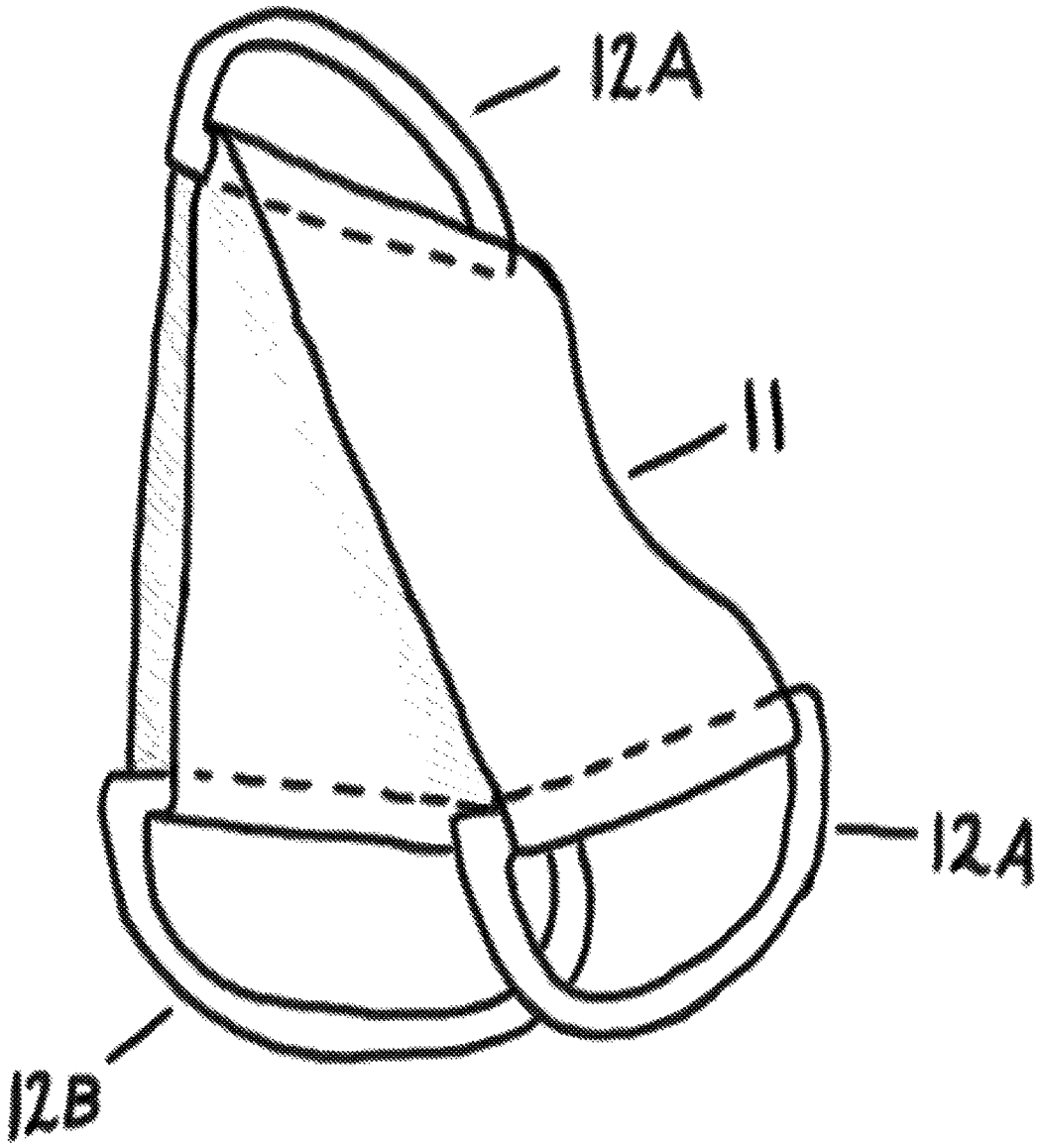
Figure 5:
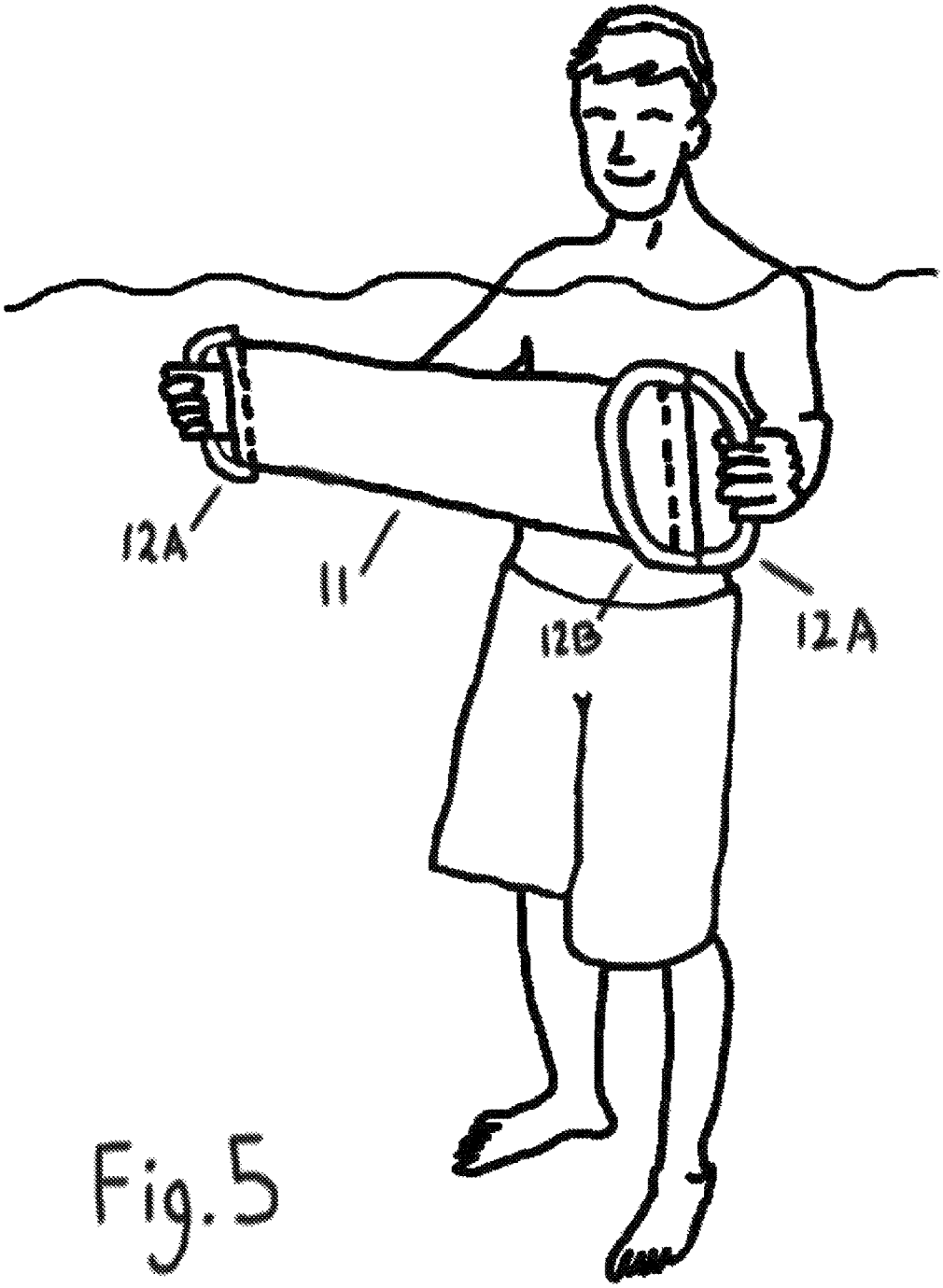
Figure 6:
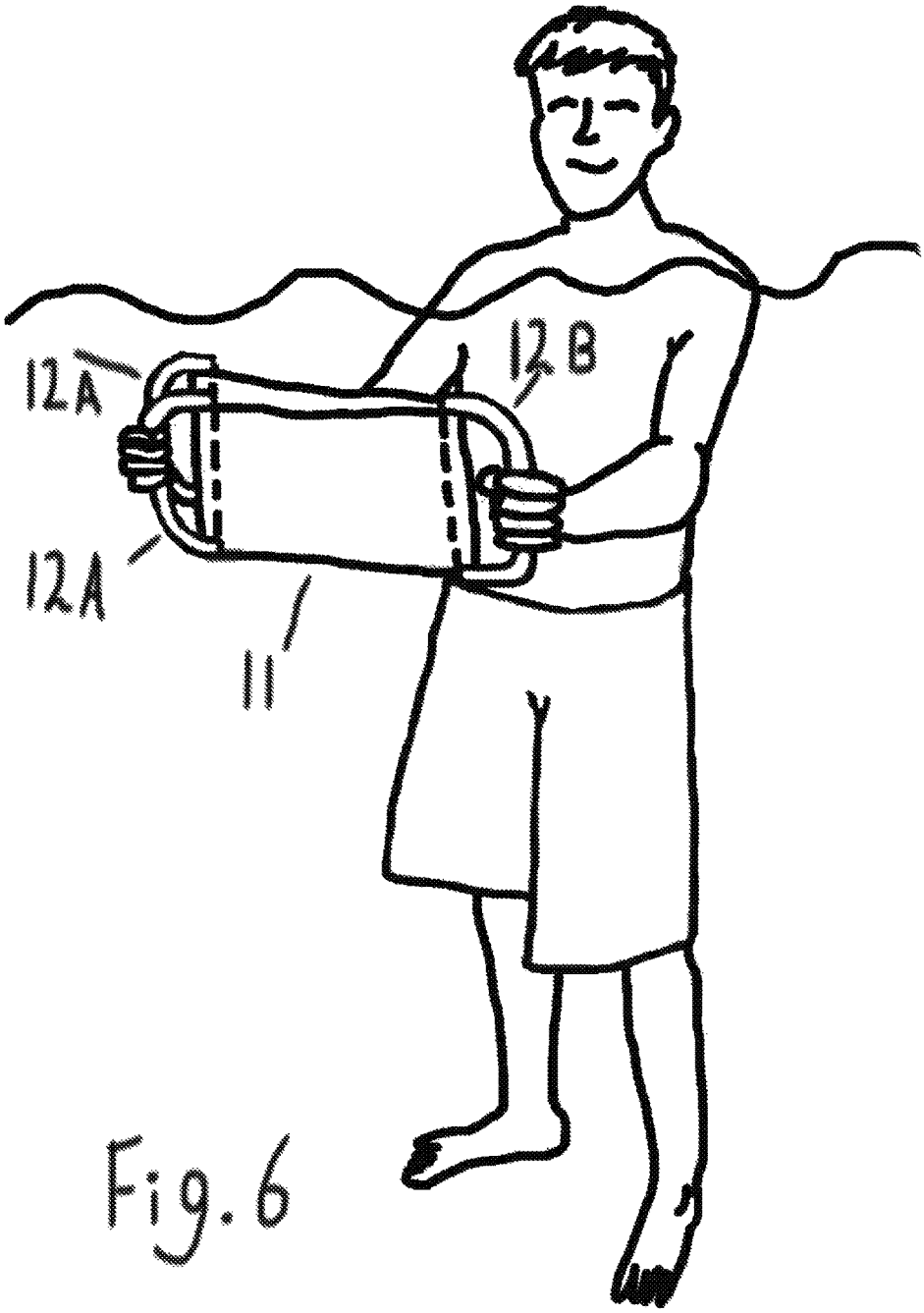
Figure 7:
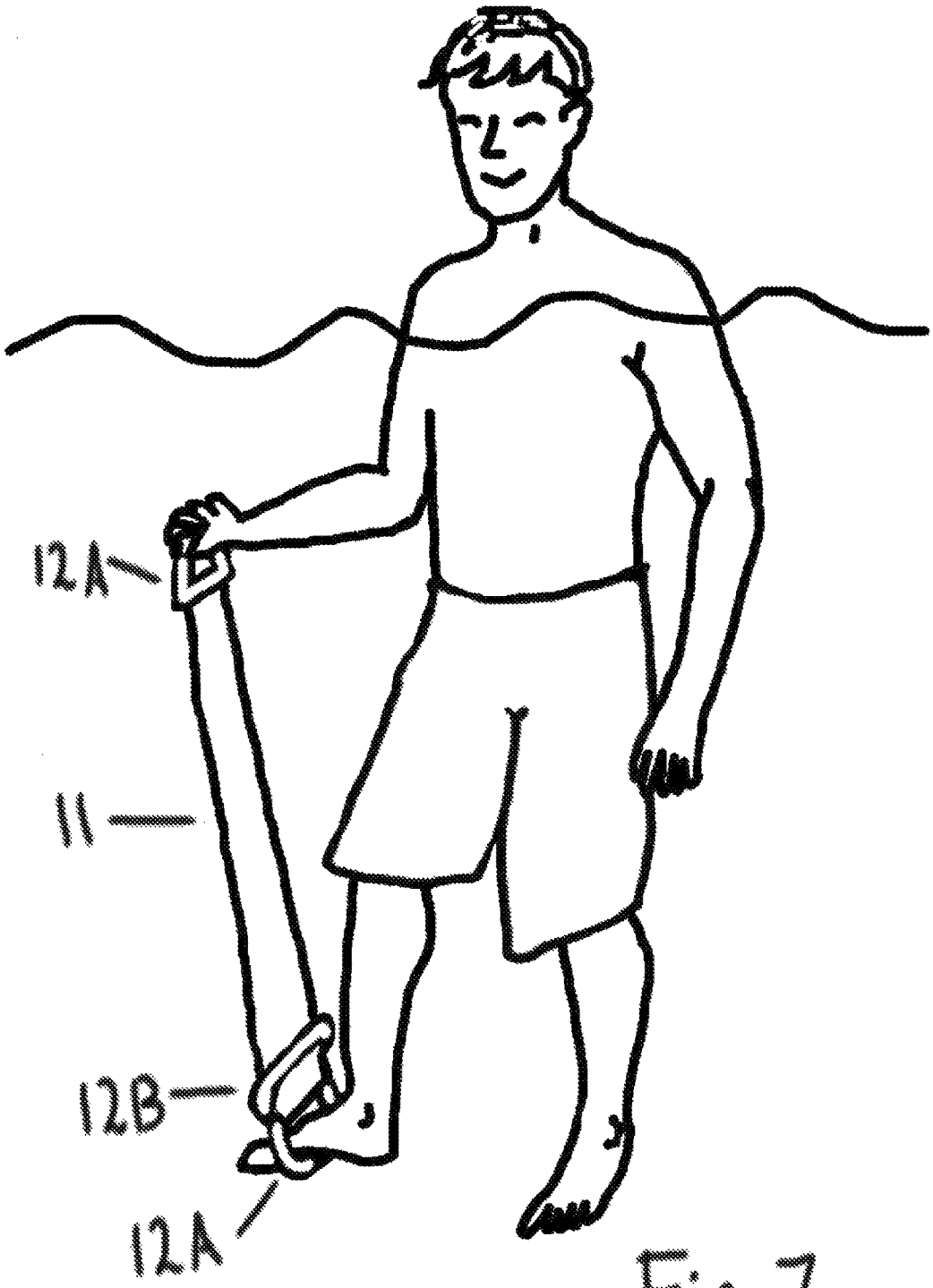
Figure 8:
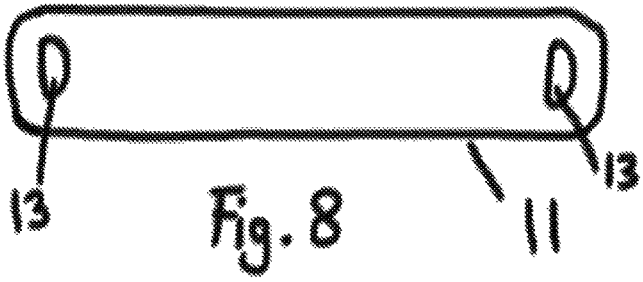
Figure 10:
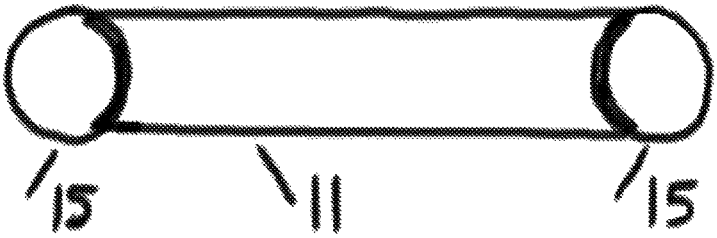

FIG. 1A) the components
FIG. 1B) first embodiment
FIG. 2) adjustability of first embodiment
FIG. 3) second embodiment
FIG. 4) a third embodiment
FIG. 5) possible use of first embodiment
FIG. 6) possible use of second embodiment (FIG. 3)
FIG. 7) other possible use of first embodiment
FIG. 8) through FIG. 10) show alternate designs of main embodiment.

REFERENCE NUMERALS

11) Rectangular piece of pliable, flexible, non-elastomeric material
12A) D-ring handles affixed at ends of rectangular material (11)

12B) D-ring handle as 12A, but freely looped around rectangular material (11)

13) Openings cut in the material (self-handles)

14) Added rib for sturdiness

15) O-ring handles

DETAILED DESCRIPTION

The adjustable drag resistance water exercise equipment is comprised of a rectangular piece of pliable material with rigid D-shaped handles affixed on either side, and an additional identical handle looped around the material. By holding handles in either one hand or both hands of a user, it can be moved through water in multiple directions through several movement planes, therefore creating more resistance for arm, leg, and core muscles than moving the arms without the device.

Referring to FIG. 1A) showing the components of the adjustable drag resistance water exercise equipment, comprised of a rectangular piece of material with a handle attached to either end and an additional handle shown beside it. The material 11 used in the first embodiment is non-permeable, highly chemical-resistant and non-elastomeric, although any non-elastomeric material can be used, as it will be apparent to those skilled in the art of this type of equipment. The material 11 is of such length that it will fit alongside a leg of an average height person, about 78 cm (31 inches) long. However, due to the ability to adjust the length of the equipment, any length of material 11 can be used without deviating from the scope of this patent. Currently I contemplate the material 11 be about 20 cm (8 inches) wide, although any width can work.

I contemplate the handles 12A and 12B of this embodiment to be D-shaped and of rigid material. The D-shape give the handles the ability to be slid through each other, and with the width of about 8 inches, the curved side will fit around a foot of a user, while the straight edge makes adjusting for size easier. The rigidity of the handles assist with form retention of the material against the force of the water.

The handles 12A at the ends of the material 11 could be attached in different ways, including but not limited to sewing, gluing, or placing grommets. However, for this embodiment I contemplate heat sealing. At this time I contemplate the handles being of PVC and neutral or negatively buoyant, although many other materials can be used as long as it can endure the moisture and chemicals associated with water exercise.

In FIG. 1B) the additional handle 12B is looped onto the material 11 to form the first embodiment. This will allow the user to switch between activities and to make adjustments for length and resistance.

FIG. 2) depicts adjusting the adjustable drag resistance water exercise equipment. By looping one handle 12A located at one end of the material 11 through the other of the attached handles 12A and the free handle 12B and pulling it all the way through, the device will become shorter. This also will cause the free handle 12B to be held in place. The length can be adjusted more by looping it more or fewer times until the desired length has been created. This will allow taller or shorter people to be able to use the device with proper body mechanics.

FIG. 3) shows the second embodiment: the first embodiment is folded in half, using the free handle 12B on one end and the two attached handles 12A on the opposite side. This allows for less resistance through the water and for performance of different exercises than with the first embodiment.

FIG. 4) refers to a third embodiment of the equipment, where the first embodiment of FIG. 1B) is adjusted to one-third of its length, as described in FIG. 2)

FIG. 5) is showing one of multiple ways the first embodiment can be held by a user, whereby the equipment is fully submerged for maximum resistance level. By holding the device in both hands and moving it through the water in different planes and directions, it will increase upper extremity strength, core strength and functional mobility, as well as coordination and joint and overall stability.

FIG. 6) depicts the second embodiment of FIG. 3) held in one of many possible ways by a user so the equipment will provide less resistance and can be used for different exercises.

FIG. 7) refers to one of the ways the first embodiment can be utilized for leg and combined arm/leg exercises FIGS. 5-6-7 are illustrations of some of the many ways the equipment can be held and used. It goes beyond the scope of this patent to try to show all the different exercises that can be performed and all functions this equipment has. Those skilled in the art of water exercise and utilizing drag resistance for water exercise will appreciate all the applications the adjustable drag resistance water exercise equipment provides.

For lower extremity strength, a person would place a foot in one of the handles 12A and hold the other handles 12A and 12B in her hand while moving her leg in different planes and directions (FIG. 7), or the person could perform arm and leg combination movements.

Length for lower extremity or combination lower/upper extremity exercises can be modified as described in FIG. 2). The length can be adjusted by looping it more or fewer times until the desired length has been created.

Figure 8A:
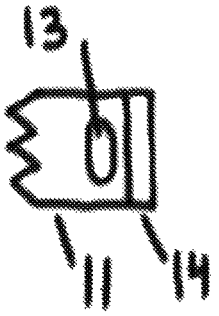
Figure 9A:
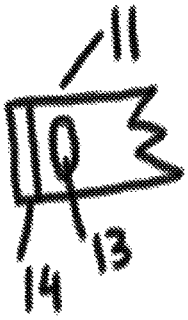
Figure 9:
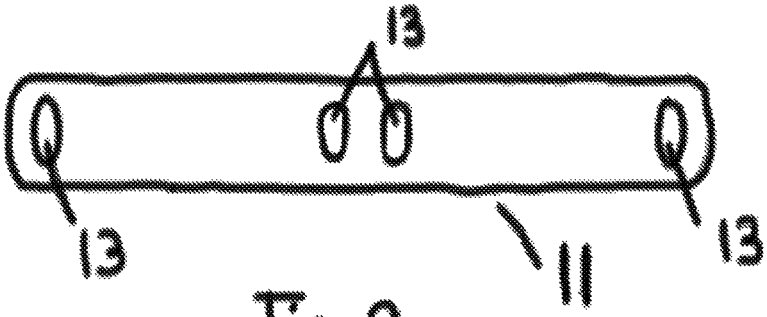

FIG. 8) and FIG. 9) show alternate embodiments, where the handles 13 are cut into the material 11, with the embodiment in FIG. 9) being much longer to provide adjustability whereas the embodiment depicted in FIG. 8) is not adjustable. FIGS. 8A) and 9A) have ribs 14 added for rigidity.

FIG. 10) illustrates an alternate embodiment of the device, with circular handles 15. This embodiment is less adjustable unless one of the handles 12A is of different diameter compared to the second handle 12A and the free handle 12B.

All the embodiments shown in FIGS. 8-9-10 are within the scope of this patent, as are all the alternatives listed in the conclusion, ramification, and scope section.

CONCLUSION, RAMIFICATION, SCOPE

The adjustable drag resistance water exercise equipment is a versatile device for water exercise. It can be used for arm, leg, and core activities, or any combination thereof. It is easily adjusted for length and resistance level and will not compromise joint alignment due to buoyancy. It is neutrally to slightly negatively buoyant, therefore it will engage more muscle groups in an active manner without putting strain on joints when trying to keep the equipment submerged. Due to the surface area and relative neutral density, it will not sink very fast and can easily be retrieved when the user accidentally loses the handle.

By using different types of material with different levels of permeability and pliability, resistance levels can be altered; however, all of these alternates will fall within the scope of this patent.

As alternative embodiment, the material 11 can have ribs placed over the width to increase rigidity against the force of the water it is being pulled through, therefore increasing the resistance level. Especially when the material is wider than the 8 inches, it tends to fold due to the force of the water; these mentioned ribs will help prevent that.

Another alternative embodiment would be where the material 11 would have openings in it, allowing the water to flow through and decreasing the intensity level. The material can be of different shapes as well; for instance, oval or circular rather than rectangular, but at this moment I contemplate rectangular for the main embodiment because of the ease of sliding it through the handles to adjust the length and resistance level. All of these embodiments fall within the scope of this patent, as will be apparent to those skilled in the art of this type of equipment.

Many different shapes will work for the handles. However, those where the length or diagonal are longer than the width or side will provide the adjustability, as will be apparent to anyone who is skilled in the art of this type of equipment.

The equipment can be used in shallow and deep water situations. When used in deeper than standing-depth water, the user will need some other equipment to remain buoyant.

It is easy to produce, therefore keeping costs down and making it more accessible for all populations (including but not limited to the elderly, obese, fit and athletic, post-trauma and rehabilitation, and children). It packs small and can be taken anywhere a user has a body of water available to exercise in and it is easily rinsed, dried, and stored.

I claim:

1. An article of adjustable drag resistance water exercise equipment comprising:

a) a piece of pliable material;

b) a first handle attached to a first end of the material and a second handle attached to a second, opposite end of the material;

c) a third handle identical to the first and second handles, the third handle being freely looped around the material such that it can slide between the first and second ends of the material;

d) wherein any one of the first, second, and third handles can slip through an opening of any other of the first, second, and third handles, thereby adjusting a length of the material; and e) wherein said handles can be placed in the hands or around a foot of a human operator to move said material through water in different planes and directions as to give resistance to the muscles of the operator.

2. The article of adjustable drag resistance water exercise equipment of claim 1, wherein the first, second, and third handles are D-ring shaped handles.

3. The article of adjustable drag resistance water exercise equipment of claim 1, the equipment being of neutral or negative buoyancy in water to minimize the risk of compromising joint alignment when trying to keep the equipment submerged while performing exercises with it.

4. The article of adjustable drag resistance water exercise equipment of claim 1, wherein said material is of rectangular shape such that adjusting the length of said material does not affect the form or function of the equipment.

5. The article of adjustable drag resistance water exercise equipment of claim 1, wherein said material is non-elastomeric and non-permeable.

* * * * *